US011613422B2

(12) United States Patent
Aviles et al.

(10) Patent No.: US 11,613,422 B2
(45) Date of Patent: Mar. 28, 2023

(54) CAPSULE SYSTEM SEATABLE WITHIN A CARTRIDGE FOR A BEVERAGE MACHINE

(71) Applicant: NOVUSFLOW LLC, East Sandwich, MA (US)

(72) Inventors: Victor M. Aviles, East Sandwich, MA (US); Carlos Alvarez, East Sandwich, MA (US); Reed Spivey, East Sandwich, MA (US); Ross Cooke, East Sandwich, MA (US)

(73) Assignee: NovusFlow LLC, East Sandwich, MA (US)

( * ) Notice: Subject to any disclaimer, the term of this patent is extended or adjusted under 35 U.S.C. 154(b) by 159 days.

(21) Appl. No.: 16/880,698

(22) Filed: May 21, 2020

(65) Prior Publication Data

US 2020/0391934 A1 Dec. 17, 2020

Related U.S. Application Data

(60) Provisional application No. 62/851,781, filed on May 23, 2019.

(51) Int. Cl.
*B65D 85/804* (2006.01)

(52) U.S. Cl.
CPC ..... *B65D 85/8061* (2020.05)

(58) Field of Classification Search
CPC ..... B65D 85/804–8067
See application file for complete search history.

(56) References Cited

U.S. PATENT DOCUMENTS

| | | | |
|---|---|---|---|
| 5,840,189 | A | 11/1998 | Sylvan et al. |
| 6,607,762 | B2 | 8/2003 | Lazaris et al. |
| 7,398,726 | B2 | 7/2008 | Streeter et al. |
| 9,227,778 | B2 | 1/2016 | Aviles et al. |

(Continued)

FOREIGN PATENT DOCUMENTS

| | | |
|---|---|---|
| WO | 2010137960 | 12/2010 |
| WO | 2011124990 | 10/2011 |

OTHER PUBLICATIONS

International Search Report and Written Opinion dated Oct. 26, 2020 corresponding to International Patent Application No. PCT/US2020/034065; 23 pages.

*Primary Examiner* — Viren A Thakur
*Assistant Examiner* — Chaim A Smith
(74) *Attorney, Agent, or Firm* — Leason Ellis LLP

(57) ABSTRACT

An improved beverage cartridge is provided for use in forming a beverage in a beverage machine that provides a pressurized liquid. The cartridge includes a container having an interior space, a lid that accommodates an inflow of the pressurized liquid, and a filter arranged to contain a beverage medium arranged to interact with a liquid to form the beverage. The cartridge also includes annular disc shaped capsule configured for placement within the container. The capsule has a hollow interior chamber that contains a beverage medium and an open bottom that is sealed closed by a membrane. The membrane is configured to selectively provide fluid communication between the space inside the container and the chamber allowing liquid introduced into the container to flow into the capsule's chamber. The membrane is also pierceable by the beverage machine to accommodate an outflow of the liquid flowing into the capsule.

19 Claims, 11 Drawing Sheets

(56) References Cited

U.S. PATENT DOCUMENTS

| | | | | |
|---|---|---|---|---|
| 2011/0033580 | A1* | 2/2011 | Biesheuvel | A23F 5/18 426/77 |
| 2012/0100259 | A1* | 4/2012 | Rapparini | B65D 85/8061 426/77 |
| 2018/0279822 | A1* | 10/2018 | Bertash | B65D 85/8046 |

* cited by examiner

CAPSULE SYSTEM SEATABLE WITHIN A CARTRIDGE FOR A BEVERAGE MACHINE

CROSS REFERENCE TO RELATED APPLICATION

The present application claims priority to U.S. Provisional Patent Application Ser. No. 62/851,781, titled CAPSULE SYSTEM SEATABLE WITHIN A CARTRIDGE FOR A BEVERAGE MACHINE and filed May 23, 2019, which is hereby incorporated by reference in its entirety.

TECHNICAL FIELD OF THE INVENTION

This invention relates to a beverage cartridge to be used with a beverage forming system, such as a single-serve coffee maker.

BACKGROUND OF THE INVENTION

Cartridges for use with beverage forming machines are well known, and can include one or more filters as well as a beverage medium, such as ground coffee beans, tea leaves, etc. In some cartridges, the filter is located between two or more portions of an interior space of the cartridge, e.g., one portion in which a beverage medium is located, and a second portion into which liquid that has passed through the permeable filter can flow. An example of one such cartridge is disclosed in U.S. Pat. Nos. 5,840,189 and/or 6,607,762, which can be used with a beverage making machine like that described in U.S. Pat. Nos. 5,840,189; 6,607,762; and 7,398,726, which are hereby incorporated by reference in their respective entireties. In use, the beverage forming machine introduces a pressurized fluid into the cartridge to interact with the beverage medium. In some machines, a piercing outlet needle of the machine is used to pierce a surface of the cartridge (e.g., a bottom wall of the cartridge container or the cartridge lid) permitting the pressurized liquid that has interacted with the beverage medium to flow through the filter and exit the cartridge.

Known cartridges are limited in that they are configured to contain one or more dry beverage mediums. These cartridges typically incorporate a permeable filter and are configured to contain ingredients within a single chamber. As such existing cartridges are not well suited to containing different ingredients that are preferably stored in separate sealed compartments prior to use and then mixed during the beverage forming process. For example, known cartridges are incapable of producing a medicinal drink in which the medicinal components must be stored in a sealed compartment and then mixed with the brewed beverage during the beverage forming process. By way of a further example, known cartridges are incapable of producing an "Irish Coffee" in which the ingredients are coffee and Irish whiskey and are formed by running water through dry coffee grounds and adding Irish whiskey. Because known cartridges are configured to use permeable filters between two or more portions of an interior space of the cartridge, e.g., one portion in which a dry beverage medium is located, and a second portion into which pressurized liquid that has passed through the permeable filter can flow, containing additional liquid or dry beverage mediums, such as a medicinal component or alcohol, etc., in the second portion of the cartridge could permeate the filter. In some cases, mixing of ingredients can spoil ingredients. In other situations, like when the beverage includes medicinal ingredients, it can be preferable for certain ingredients to be sealed and isolated from other ingredients during manufacturing and during storage of the finished product prior to use. To the extent the containers used in existing cartridges could possibly be redesigned to include integrally formed dividers that define separate chambers for containing different ingredients, the redesign and retooling of existing manufacturing processes can be costly and inconvenient.

One departure in cartridge designs is known from U.S. Pat. No. 9,227,778 in which dry and wet media or two dry media are maintained separate in the cartridge, yet both interact with the injected liquid when used in a beverage machine.

Accordingly, it is desirable to provide improved systems and methods for providing a beverage cartridge that can contain multiple different beverage mediums without mixing the multiple beverage mediums substantially prior to forming a beverage and without requiring significant redesign of existing beverage cartridge systems. This cartridge, however, has a dedicated design and while providing an improvement in the art, there remains a need in the art to provide such a cartridge without requiring significant redesign of existing beverage cartridge systems

SUMMARY OF THE INVENTION

According to a first aspect, an ingredient capsule is provided. The ingredient capsule is for use with a cartridge used in forming a beverage in a beverage machine which provides a pressurized liquid. The cartridge can have a container defining an interior space, a lid closing an open top end of the container and that is pierceable by the beverage machine to accommodate an inflow of the liquid into the interior space to form the beverage. The cartridge can also include a filter disposed within the interior space and containing a first beverage medium arranged to interact with the liquid introduced into the container to form the beverage. In particular, the capsule comprises a body. The body has an annular disc shape and a hollow interior chamber and having an open bottom end. The body is sized and shaped to be placed within the interior space of the container and positioned with the bottom end of the cartridge proximate to a bottom end of the container. The capsule further comprises a membrane attached to the body and closing the open bottom end of the body. The membrane is configured to selectively provide fluid communication between the interior space of the container and the chamber such that pressurized liquid introduced into the interior space of the container can flow into the interior chamber. In addition, the membrane is pierceable by the beverage machine to accommodate an outflow of the liquid flowing into the interior chamber. Additionally, the capsule further comprises a beverage medium provided within the interior chamber and sealed therein by the membrane. The beverage medium is arranged to interact with the liquid introduced into the container to form the beverage and flowing into the interior chamber.

These and other aspects of the invention will be apparent from the following description and claims.

BRIEF DESCRIPTION OF DRAWINGS

Aspects of the invention are described below with reference to the following drawings in which like numerals reference like elements, and wherein.

DETAILED DESCRIPTION OF CERTAIN EMBODIMENTS OF THE INVENTION

It should be understood that aspects of the invention are described herein with reference to the figures, which show illustrative embodiments. The illustrative embodiments described herein are not necessarily intended to show all embodiments in accordance with the invention, but rather are used to describe a few illustrative embodiments. Thus, aspects of the invention are not intended to be construed narrowly in view of the illustrative embodiments. In addition, it should be understood that aspects of the invention can be used alone or in any suitable combination with other aspects of the invention.

Figure 1:
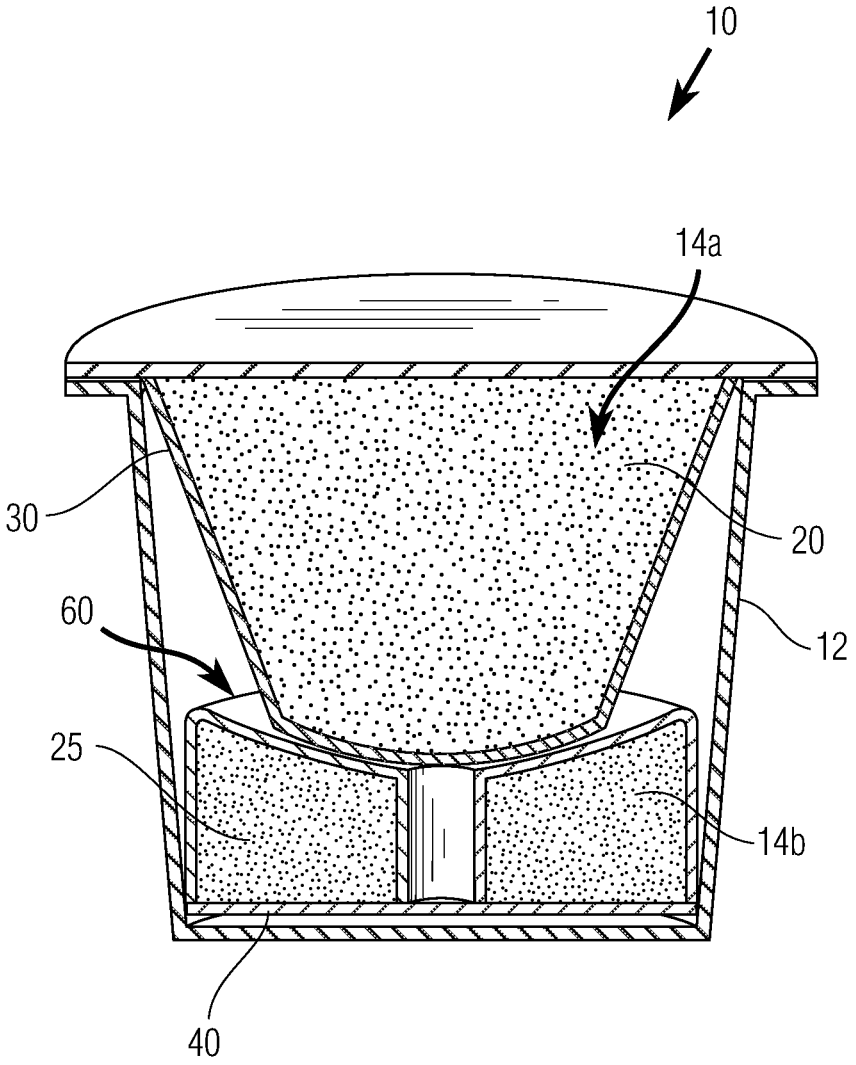
FIG. 1 is a side cross-sectional view of a cartridge in accordance with aspects of the invention.
Figure 2:
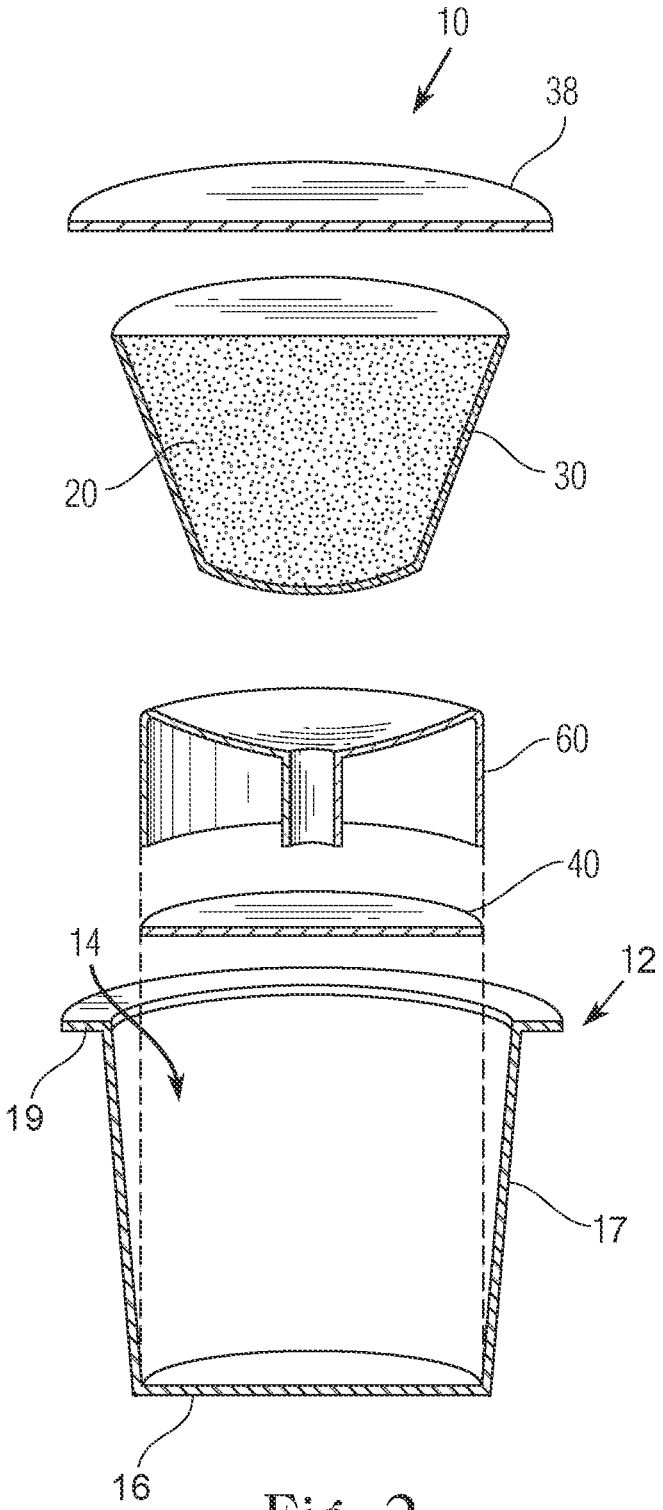
FIG. 2 is an exploded perspective view of the cartridge of FIG. 1.

FIGS. 1 and 2 show a side cross-sectional view and an exploded perspective view, respectively, of an illustrative cartridge 10 that incorporates one or more aspects of the invention. The cartridge 10 can be used in a beverage machine to form any suitable beverage such as tea, coffee, other infusion-type beverages formed from one or more beverage ingredients and a liquid, such as pressurized, chilled, carbonated, and/or heated water.

For simplicity, the exemplary improved beverage cartridge 10 configurations that are further described herein in connection with FIGS. 1 through 9 are described as being based on a basic beverage cartridge configuration. It should be understood, however, that the disclosed embodiments can be incorporated with any number of different types of beverage cartridges, sachets, pods or containers that are currently known and realized in the future without departing from the scope of the disclosed invention. Accordingly, certain features relating to the capsule of the improved beverage cartridge system are further described herein in detail, whereas standard features of known beverage cartridges are described only to the extent considered necessary to explain and emphasize the novel features.

The cartridge 10 can be configured to contain any suitable first beverage medium 20, e.g., ground coffee, tea leaves, dry herbal tea, powdered beverage concentrate and/or other beverage-making material (such as powdered milk or other creamers, sweeteners, thickeners, flavorings, and so on). In accordance with a salient aspect of the invention, the cartridge can also contain a capsule sub-assembly (hereinafter capsule) that is also configured to contain a beverage medium. In some arrangements the beverage mediums can comprise one or more dry or liquid mediums. As shown in FIG. 1, the capsule contains a dry or liquid beverage medium 25, e.g. a medicinal product, an alcoholic ingredient, dairy product, liquid flavoring and the like. In one illustrative embodiment, the cartridge 10 also contains a beverage medium 20 and are configured for use with a machine that forms coffee and/or tea beverages, however, aspects of the invention are not limited in this respect.

In the illustrative embodiment, the cartridge 10 includes a container 12 having an interior space 14. A filter 30 is disposed within the interior space 14 and defines a first region 14*a* therein. The filter 30 is configured to contain a first beverage medium 20 within the first region 14*a*.

In this embodiment, the container 12 can have a frusto-conical cup shape with sidewalls, a closed bottom-end wall 16, and an opening at a top end. However, in other embodiments, the container 12 can have a fluted, conical, or cylindrical shape, can be in the form of a square or rectangular cup, a domed cup, a sphere or partial sphere, or other suitable form, can have a fluted, corrugated, or otherwise shaped sidewall, and so on. Also, the container 12 need not necessarily have a defined shape, as is the case with some beverage sachets and pods. For example, although the container 12 in this embodiment has a relatively rigid and/or resilient construction so that the container 12 tends to maintain its shape, the container 12 could be made to have a more compliant and/or deformable arrangement, e.g., like a sachet container made from a sheet of deformable material.

If the container 12 includes an opening, the opening can be closed by a lid 38, e.g., a foil and polymer laminate material that is attached to a rim 19 of the container 12. Although in this embodiment a rim is provided at the top end of the container 12 as an annular flange-like element, the rim can be arranged in other ways. For example, the rim can be the top edge of the sidewall 17 without any flange element. The container 12 and/or the lid 38 can provide a barrier to moisture and/or gases, such as oxygen. For example, the container 12 can be made of a polymer laminate, e.g., formed from a sheet including a layer of polystyrene or polypropylene and a layer of EVOH and/or other barrier material, such as a metallic foil. Such an arrangement can provide suitable protection for the first beverage medium 20, e.g., from unwanted exposure from moisture, oxygen and/or other materials. It should be understood, however, that the container 12 and/or the lid 38 can be made of other materials or combinations of materials, such as biopolymers, compostable polymers, paper, foils, etc.

In accordance with an aspect of the invention, the filter 30 is disposed within the interior volume and defines the first region 14*a* and can be attached to the lid 38. Alternatively, the filter can be attached to the container or freely disposed within the container and unattached to the container or the lid. As mentioned above, the filter 30 can be arranged in the interior space 14 so that liquid introduced into the first region 14*a* of the interior space (e.g., that interacts with beverage medium 20) flows through the filter 30. The filter 30 can function to remove materials over a certain size from a liquid, e.g., can remove coffee grounds from liquid mixed in the first region 14*a*, allowing a coffee beverage to pass through the filter 30 to the interior space below the filter. In this illustrative embodiment, the filter 30 can have a substantially domed shape. However, the filter 30 can have any suitable shape, such as a cylindrical shape, a square cup shape, a frustoconical shape, a flat sheet, or other. The filter 30 can be the attached to the lid 38 in any suitable way, such as by an adhesive, thermal welding, ultrasonic welding, chemical bonding, crimping or other mechanical bonding.

As would be understood, various types of cartridges for use with beverage forming machines are well known in the art. The beverage cartridge 10 shown in FIG. 1 comprises a known container and filter configuration that is improved by the inclusion of capsule 60 within the interior volume 14 of the container 12, in accordance with one or more aspects of the invention. Generally, the capsule 60 is configured to have a hollow interior volume comprising at least one chamber for containing one or more beverage mediums therein. The capsule is configured to enclose a beverage medium within an interior volume of the capsule so as to contain the second beverage medium in a sealed manner when stored, but provides fluid communication between the interior volume of the capsule and the surrounding volume of the container 12 when the cartridge 10 is used to form a beverage. According to a salient aspect of one or more embodiments, the capsule 60 is specifically designed to be used with existing cartridge designs and components. This facilitates manufacture of an improved cartridge 10 without requiring significant re-designs of existing components or undue interference with existing manufacturing processes.

Exemplary structural configurations of a capsule in accordance with one or more embodiments are further described herein with reference to FIGS. 1-5C. FIG. 2 is an exploded, perspective cut-away view of the cartridge 10 of FIG. 1. FIG. 3A is an exploded perspective view of the cartridge 10, including the container 12 and capsule 60, and omitting the filter, lid and beverage mediums. FIG. 3B is an exploded, perspective and cut-away view of the container and capsule shown in FIG. 3A. FIG. 4A is an isolated, perspective view of the capsule 60 including the membrane 40. FIG. 4B is an isolated, perspective view of the capsule 60 and excluding the membrane 40.

As shown, the capsule 60 is shaped like an annular disk and has a generally hollow interior volume. The capsule comprises one or more structural walls including an annular top wall 62 that extends between a cylindrical inner wall 66 and a cylindrical outer wall 64 that extend in a generally vertical direction. The bottom wall of the capsule comprises a membrane 40 arranged to enclose the hollow interior volume of the capsule 60. The membrane is configured to seal against the bottom end 63 of the cylindrical outer wall 64 and against the bottom end 67 of the cylindrical inner wall 66. In addition, the membrane extends across the bottom end of the cylindrical inner wall and thereby closes the otherwise open passageway 65 that extends through the cylindrical inner wall 66. In one example, the cylindrical outer wall can have an inner diameter of 35 mm; the height of the hollow chamber within the capsule can be 8 mm; the diameter of the inner passageway formed by the cylindrical inner wall can be 6 mm. Accordingly, the approximate volume of the chamber in this example is 7 ml.

The capsule 60 is configured to have a hollow interior volume comprising at least one chamber, namely, chamber 14*b*. The membrane 40 is configured to selectively isolate the second chamber from the surrounding space. More specifically, the membrane is configured to seal against the walls of the capsule such that the contents of the chamber 14*b* are sealed within the capsule when stored, but provides fluid communication between the first and second chambers when the cartridge is used to form a beverage. More specifically, as further described herein, the membrane is configured to selectively detach from the cylindrical inner wall in response to the injection of a liquid into the interior volume and is further configured to deflect such that fluid can pass through the central passageway 65 and into the chamber 14*b*. The membrane is configured to detach from the wall as a function of one or more of pressure and heat from the injected liquid. Furthermore, the membrane 40 is pierceable by an outlet piercing element 52 to permit the outflow of liquid through the pierced membrane.

Figure 6A:
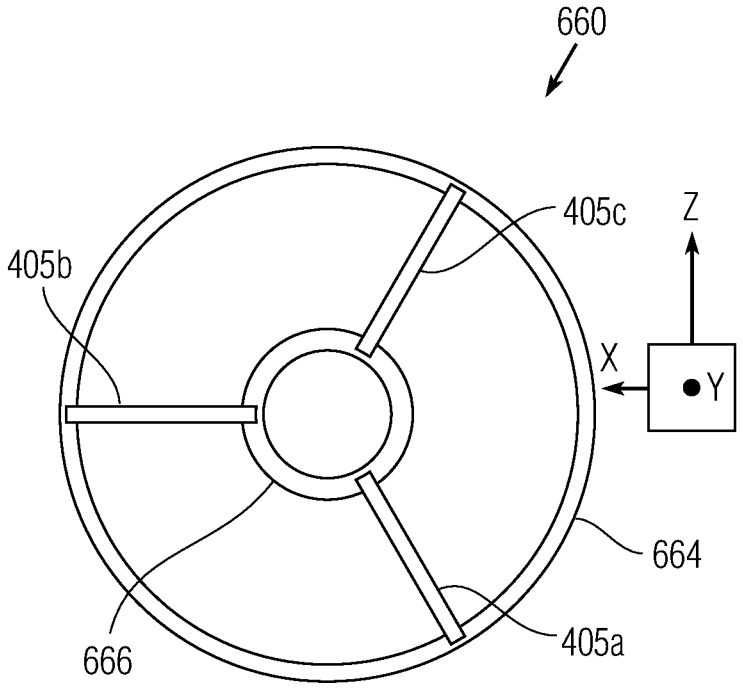
FIG. 6A shows a top cross-sectional view of another illustrative embodiment of a capsule in accordance with an aspect of the invention.
Figure 6B:
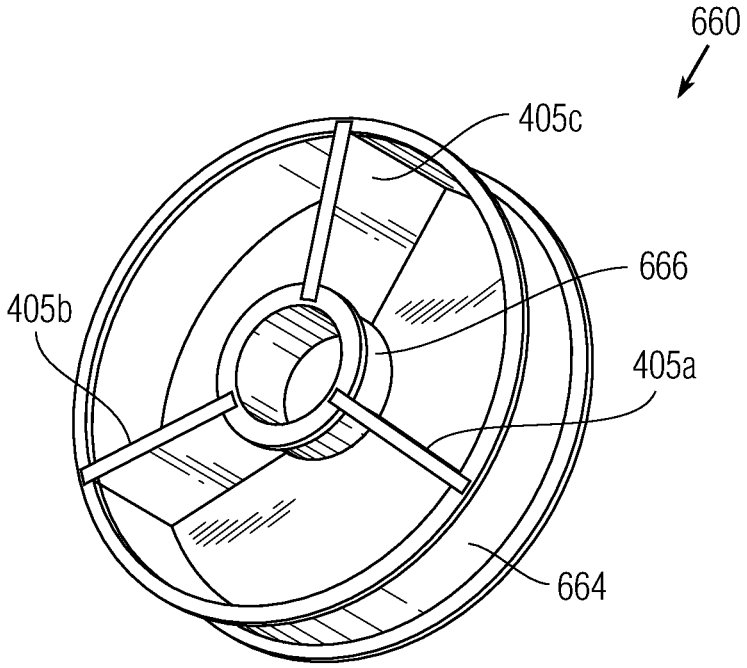
FIG. 6B is a perspective view of the capsule of 6A.

While the hollow interior volume of the capsule 60 is shown as including a single chamber 14*b*, it should be understood, however, that additional chambers in the interior volume of the capsule can be provided in other embodiments. For example, as shown in FIG. 6A, which is a top-plan view of an exemplary capsule 660 with the top wall and membrane omitted for simplicity, the capsule can include radially extending internal walls 405*a*, 405*b* and 405*c* that extend from cylindrical inner wall 666 to cylindrical outer wall 664 and define separate radially extending chambers within the interior volume of the cartridge, each of which are enclosed by a bottom membrane (not shown) and top wall (not shown). FIG. 6B provides a bottom perspective view of the capsule 660 with the membrane omitted. Similarly, while the surrounding interior volume of the container 12 is shown and described as including a filter that defines a first region 14*a* within the interior volume, it should be understood that the interior volume of the container 12 can be divided or otherwise separated into two or more portions or areas by filters, walls, dividers, passageways, and other features.

Figure 4A:
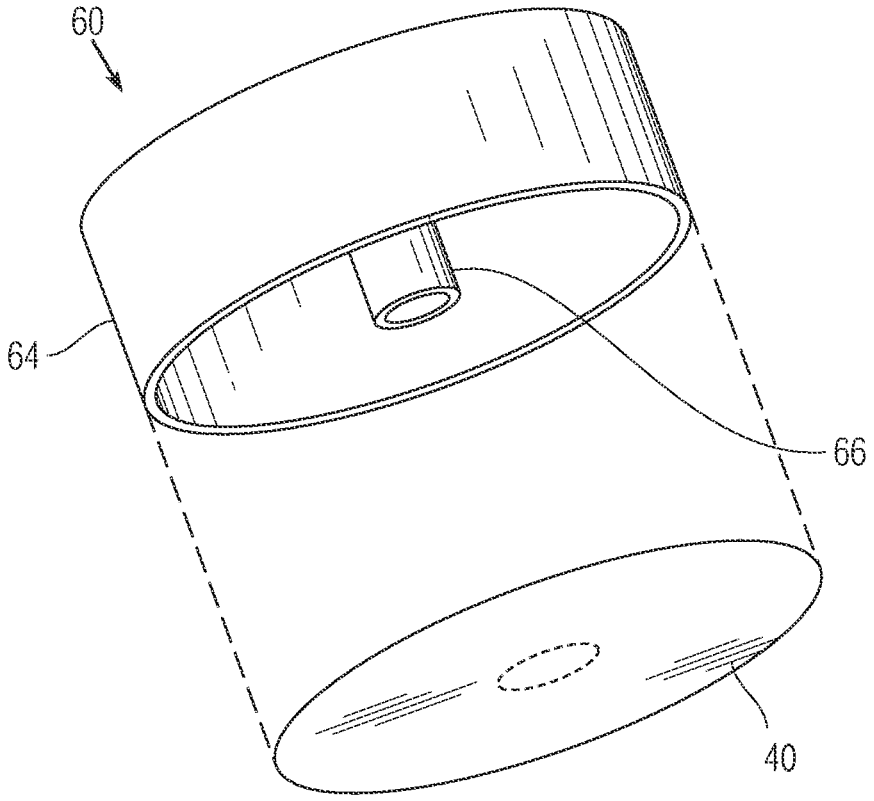
FIG. 4A is an isolated, perspective view of an exemplary capsule and a membrane in accordance with aspects of the invention.
Figure 4B:
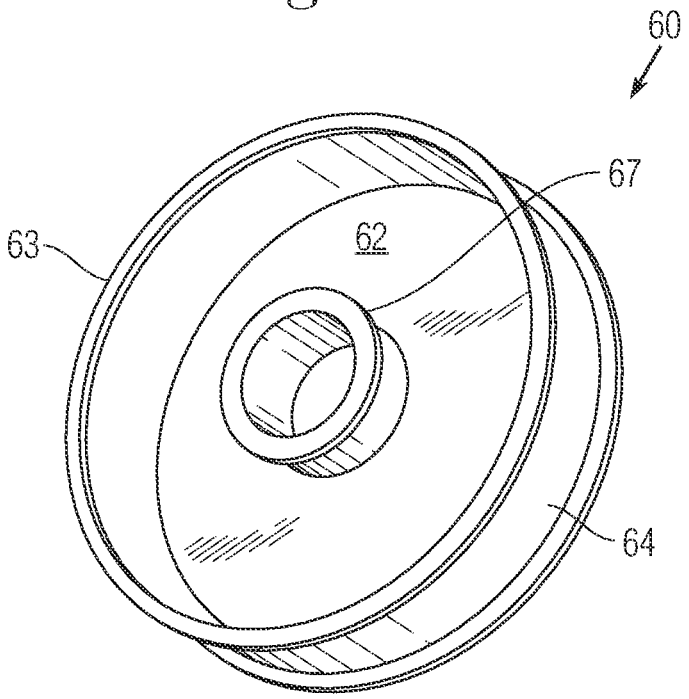
FIG. 4B is an isolated, perspective view of the capsule of FIG. 4A excluding the membrane.

Turning to FIG. 4A-4B, in accordance with an aspect of the invention, the membrane 40 can be attached to a bottom end of the cylindrical outer sidewall 64 and similarly attached to a bottom end of the cylindrical inner sidewall 62. It should be understood that the cylindrical sidewalls can be formed to have a non-cylindrical or semi-cylindrical shape. For instance, the bottom end of the inner and cylindrical outer sidewalls can be shaped to include an annular flange that extends toward the other sidewall. Such an annular rim can provide a larger contact surface between the membrane 40 and sidewalls thereby promoting adhesion and sealing.

Figure 3A:
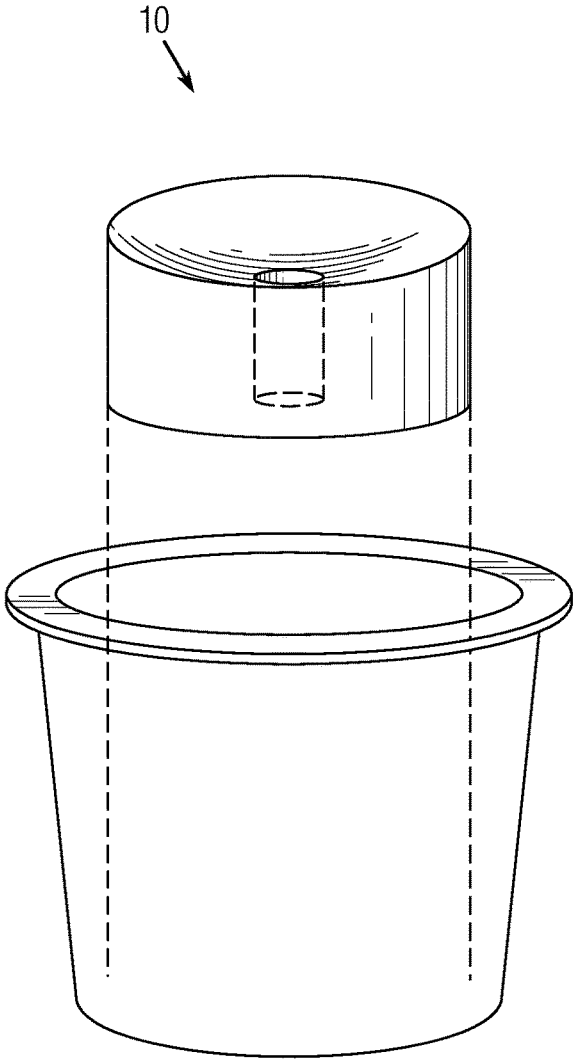
FIG. 3A is an exploded perspective view of the cartridge of FIG. 1 including only the container and capsule in accordance with an aspect of the invention.
Figure 3B:
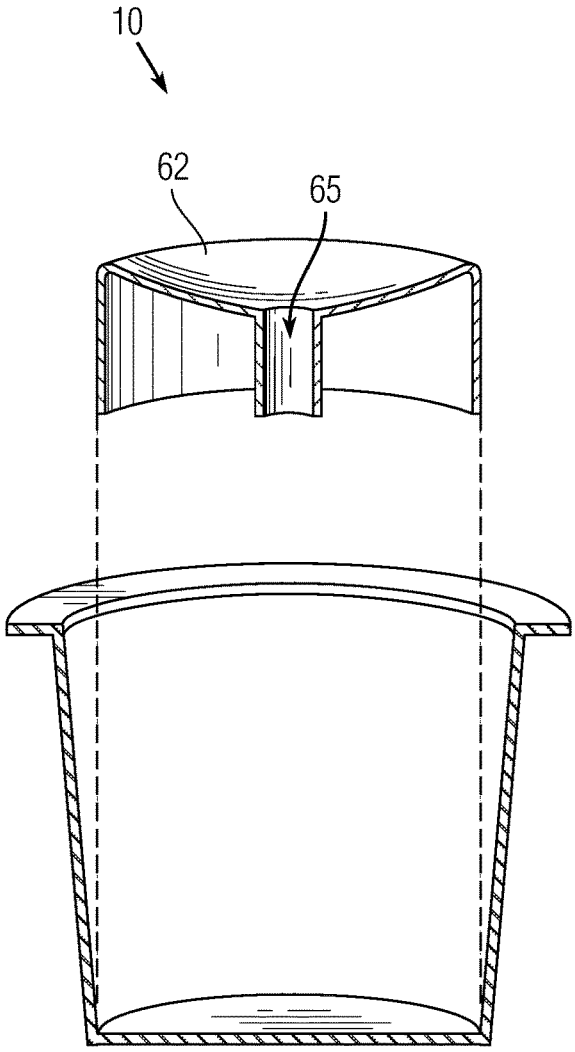
FIG. 3B is an exploded, perspective, cut-away view of the cartridge of FIG. 1 including only the container and an exemplary capsule in accordance with aspects of the invention.

In the illustrative embodiment shown in FIG. 3A, the top wall 62 and the membrane 40 can have a substantially flat shape, as shown. However, the top wall or the membrane 40 can have any suitable shape. For instance, as shown in FIG. 3B, the capsule 60 can be shaped such that the cylindrical outer sidewall is taller than the cylindrical inner sidewall and, as such, the top wall slopes downward from the cylindrical outer sidewall to the cylindrical inner sidewall. Such a configuration can promote the flow of liquid within the container through the central passageway 65 defined by the cylindrical inner sidewall.

The membrane 40 can be the attached to the walls of the capsule, in any suitable way, such as by an adhesive, thermal welding, ultrasonic welding, chemical bonding, crimping or other mechanical bonding, etc. and combinations thereof. In one exemplary embodiment, a food-safe adhesive is used. It should be understood that, depending on the application requirements, any number of different natural and synthetic food-safe adhesives meeting applicable government regulations and industry standards can be used. For instance, Animal Glue, offered by LD Davis Corp. of Jenkintown, Pa., is one example of a non-toxic and biodegradable glue that is commonly used in food packaging. Glue Dots™ by Glue Dots International of Germantown, Wis. is another exemplary food-safe adhesive.

The bond formed between the membrane and one or more portions of the capsule walls preferably has a suitable adhesion strength to hold during storage in accordance with industry standard shelf life testing standards. Importantly, at least a portion of the bond should have a suitable breaking point in order to facilitate beverage forming as further described herein. For instance, in the illustrative embodiments, the attachment to the inner sidewall can be provided by a food-safe adhesive having a breaking threshold that is suitable for selectively breaking when a liquid is injected with pressure by a typical beverage forming machine into the cartridge to form a beverage. The bond can also be formed such that thermal influence from the injected liquid causes the membrane to release from the inner sidewall.

Figure 4C:
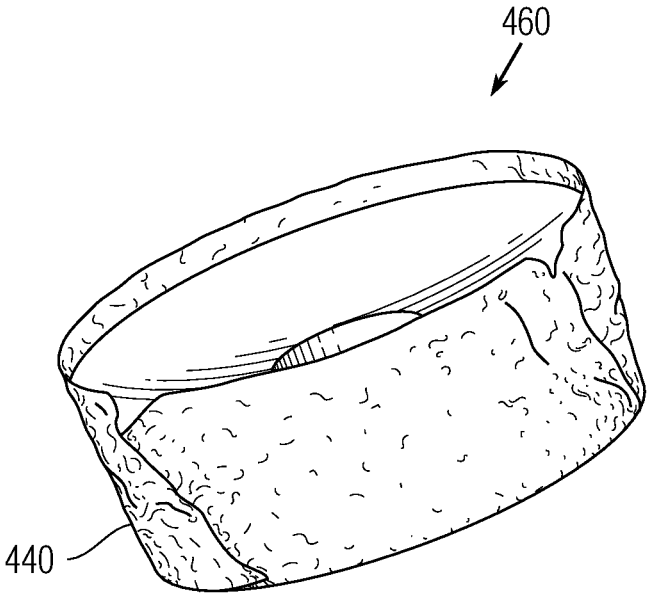
FIG. 4C is a perspective view of an exemplary capsule and a membrane wrapped around the outer sidewalls in accordance with aspects of the invention.

In addition, the attachment between the membrane and outer sidewall can be specifically configured such that the membrane does not detach from the outer wall during beverage forming. In one exemplary configuration, the bond between the membrane and the outer wall can be achieved using another joining means, for instance, an adhesive that is configured to have a higher breaking threshold so as to not break during beverage formation. In another exemplary arrangement, the adhesive bond that is formed between the outer wall and membrane and that extends along or about the outer wall can be wider than the bond between the membrane and inner cylindrical wall and, thus, stronger. The resistance to separation can be defined, for example, by sizing the contact patch between one or more of the walls and the membrane accordingly. In addition, the length and width of the adhered surface area can also be defined to achieve the appropriate sealing strength. For example, the membrane can have a greater diameter than the circumferential outer wall such that the membrane contacts the bottom end of the outer wall and is folded over or wrapped around the edge so as to extend at least partially up the outer surface of the outer sidewall in the direction of the top end. FIG. 4C is a perspective view of an exemplary capsule 460 and a membrane 440 wrapped about the outer sidewalls in accordance with aspects of the invention. In such a configuration, the membrane can also be adhered to one or more of the outer surface of the outer sidewall, the bottom end of the outer sidewall or a combination of the foregoing. In addition or alternatively, the membrane can be crimped circumferentially about the outer sidewall. It can also be appreciated that the folding of the membrane over the bottom edge of the sidewall and wrapping the membrane around the sidewalls also serves to mechanically resist separation. Moreover, placement of the capsule within the container 12 such that the folded edge of the membrane abuts the container wall can further serve to resist separation.

As will be understood, the shape of the membrane 40 can depend on the shape of the opening in the capsule 60 that is being sealed by the membrane. For instance, in the embodiment shown in FIGS. 1-4B, the shape of the membrane is defined by the shape of the cylindrical outer sidewall 64. In this embodiment, the membrane has a circular shape, but oval, rectangular, triangular, irregular, and other shapes are possible to accommodate different capsule shapes and configurations. It should also be understood that multiple membranes can be provided, for instance, in configurations where multiple openings and fluid passageways are provided in the structural body of the capsule.

In this illustrative embodiment, the membrane 40 can be fluid non-permeable. In addition, or alternatively, the membrane can be permeable to fluids and/or gasses. constructed from a fluid non-permeable material including polypropylene and cellulose material, a polymer laminate, e.g., formed from a sheet including a layer of polystyrene or polypropylene and a layer of EVOH and/or other barrier material. Also, the membrane can have an elasticity suitable for a beverage introduced through the inlet piercing element during beverage forming to separate the membrane away from the bottom end of the cylindrical inner wall and allow fluid to flow into and/or out of the capsule. Another exemplary material for the membrane, such as the membrane shown and described as being crimped about the outer sidewall in FIG. 4C, is a metallic foil.

Figure 5A:
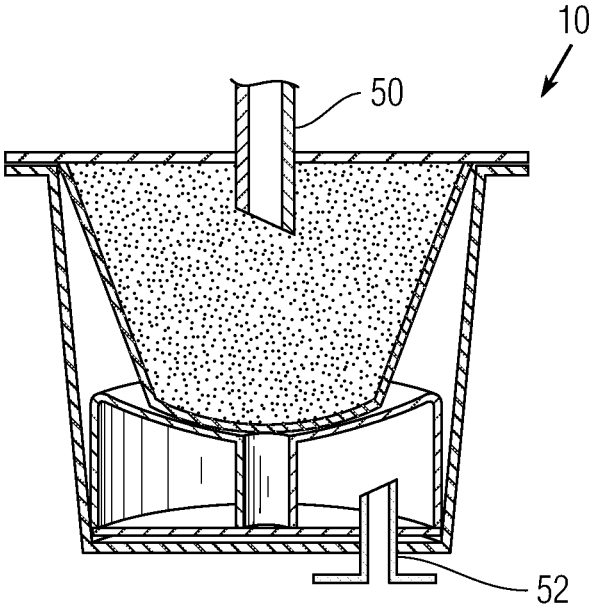
FIG. 5A is a cut-away side view showing an exemplary cartridge in accordance with aspects of the invention with the beverage mediums excluded.
Figure 5B:
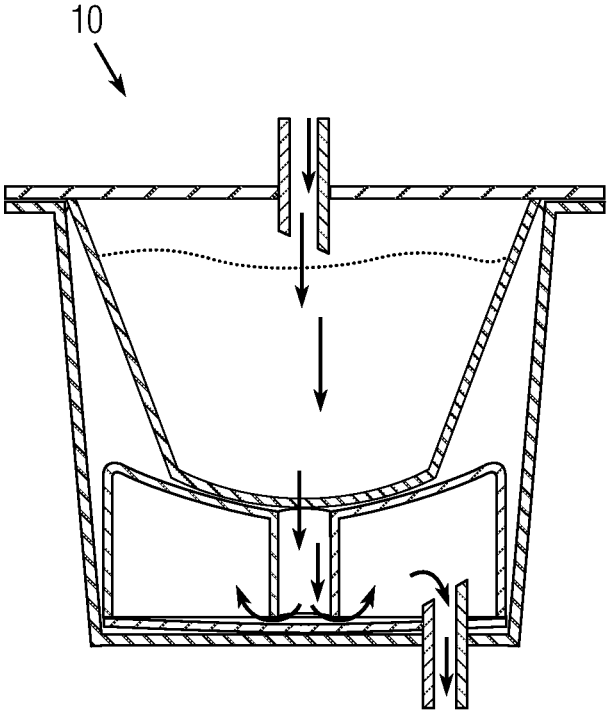
FIG. 5B is a cut-away side view showing an exemplary cartridge in accordance with aspects of the invention and illustrating the flow of fluid into and through the cartridge during the beverage forming process.
Figure 5C:
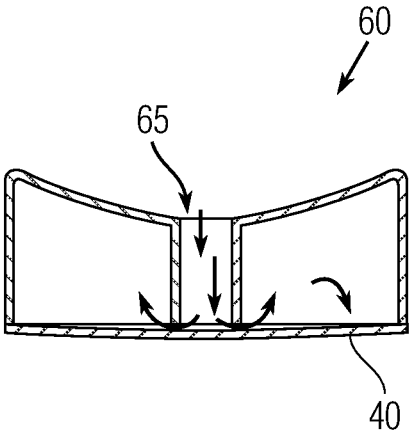
FIG. 5C is a close-up view of an exemplary capsule in accordance with aspects of the invention and illustrating the flow of fluid into and through the capsule during the beverage forming process.

The exemplary function of the improved cartridge 10 that includes the capsule 60 is further described herein in connection with FIGS. 5A-5C. FIG. 5A side cross-sectional view of a cartridge shown in FIG. 1 being punctured by inlet needle and outlet needles. In this illustrative embodiment, first region 14*a* contains a first beverage medium, say a dry beverage medium like tea, and sealed within the capsule 60 is another beverage medium, say, a dry or liquid medicinal substance that is preferably kept sealed within the capsule until it is used to form a beverage.

In order to form a beverage using the cartridge 10, it is preferable to allow the contents contained within the first portion 14*a*, and the contents within the capsule to mix with the liquid introduced into the cartridge by a beverage forming apparatus. FIG. 5B is a cut-away side view showing the exemplary cartridge 10 including beverage mediums and showing the flow of various components of the beverage into and through the cartridge 10 during the beverage forming process.

When using the cartridge 10 to form a beverage, the lid 38 and/or the container 12 can be pierced to introduce liquid into the cartridge and receive beverage from the cartridge. As used herein, "beverage" refers to a liquid substance intended for drinking that is formed when a liquid interacts with the one or more beverage mediums contained within the cartridge. Thus, beverage refers to a liquid that is ready for consumption, e.g., is suitable for being dispensed into a cup and ready for drinking, as well as a liquid that will undergo other processes or treatments, such as filtering or the addition of flavorings, creamer, sweeteners, another beverage, etc., before being consumed.

To introduce liquid into the cartridge, for example, a portion of the lid 38 can be pierced by an inlet piercing element 50 (e.g., a needle) so that water or other liquid can be injected into the cartridge 10. Other inlet piercing arrangements are possible, such as multiple needles, a shower head, a non-hollow needle, a cone, a pyramid, a knife, a blade, etc. A beverage machine that uses the cartridge can include multiple piercing elements of the same type or of different types, as the invention is not limited in this respect. In another arrangement, a beverage machine can include a piercing element (such as a spike) that forms an opening and thereafter a second inlet element (such as a tube) can pass through the formed hole to introduce liquid into (or conduct liquid out of) the container. In other embodiments, the lid 38 can be pierced, or otherwise effectively opened for flow, by introducing pressure at an exterior of the lid 38. For example, a water inlet can be pressed and sealed to the lid 38 exterior and water pressure introduced at the site. The water pressure can cause the lid 38 to be pierced or otherwise opened to allow flow into the cartridge 10. In another arrangement, the lid 38 can include a valve, conduit or other structure that opens when exposed to a suitable pressure and/or when mated with a water inlet tube or other structure.

The capsule 60 is configured such that, during the beverage forming process, the beverage component formed from mixing the liquid with the first beverage medium is also mixed with the beverage medium stored within the capsule 60. As mentioned above, the membrane of the capsule can selectively open, by way of a frangible seal that permits fluid communication between the region outside the capsule and the chamber within the capsule. In one exemplary embodiment, when pressurized liquid is introduced into the first region 14*a*, the membrane serves to allow the beverage mixed in region 14*a* to flow into the capsule (e.g., the chamber 14*b*).

More specifically, as shown in FIG. 5B, introduction of pressurized liquid through the lid and into the interior 14 causes the liquid to mix with any contents of region 14*a* and flow through the filter. The mixture then flows into the central passageway 65 defined by the cylindrical inner wall 66 of the capsule 60. Because the membrane 40 extends across and is attached to the bottom end of the (cylindrical) inner wall 66, pressure (and/or heat) against the membrane 40 from the liquid within the passageway 65 causes the adhesion between the membrane and inner cylindrical wall to yield to the fluid pressure. In addition, as shown in FIG. 5C, which is a cut-away side view of the capsule during the beverage forming process, the pressure from the liquid causes the membrane to separate from the bottom end and allows the liquid to flow into the chamber, thus mixing with the contents of the chamber. Preferably, the attachment between the membrane and the cylindrical outer wall does not break from the liquid pressure. Thus, the exemplary capsule configuration and its application where a puncturing outlet needle penetrates both the bottom of the cup and the bottom membrane of the capsule 60, serves to direct the flow of water through the chamber.

In some arrangements, the membrane can be made of a material having an elasticity that is suitable for being pushed away from the bottom end. In addition or alternatively, the membrane can be configured such that it naturally separates from the bottom end when the adhesion is broken and allows fluid communication between the interior and exterior of the capsule 60. Accordingly, in some arrangements, the capsule is positioned slightly above the bottom of the container 12 such that the bottom wall does not interfere with the separation of the membrane from the cylindrical inner wall 66.

The cartridge 10 can also be penetrated by an outlet piercing element 52 (e.g., a needle) at a bottom 16 of the container 12. As with the inlet piercing arrangement, the outlet piercing arrangement can be varied in any suitable way. As shown in FIGS. 5A and 5B, the container 12 and the capsule 60 can be arranged such that the outlet piercing element 52 penetrates through the bottom of the container and penetrates through the bottom side of the capsule 60 (e.g., through the membrane 40) such that liquid introduced into the cartridge and flowing into the capsule 60 can exit the cartridge through the outlet provided by the outlet piercing element 52. Thus, the outlet piercing element can include one or more hollow or solid needles, knives, blades, tubes, and so on. Also, in this illustrative embodiment the piercing element remains in place to receive beverage as it exits the opening formed in the container 12. However, in other embodiments, the piercing element can withdraw after forming an opening, allowing beverage to exit the opening and be received without the piercing element being extended into the cartridge 10. Although the embodiments described above are described as including a single beverage medium in the first region 14*a* and a single beverage medium within the chamber 14*b* inside the capsule 60, those embodiments can include fewer or more than one beverage medium. For example, a cartridge can include ground coffee in one interior region of the container and a creamer within the capsule, enabling the cartridge to form a cappuccino- or latte-like beverage. In another embodiment, the inner volume of the container can be divided into multiple regions having respective beverage ingredients in addition to including a capsule having one or more ingredients contained therein. In yet another embodiment, the capsule can include multiple beverage mediums provided within respective chambers inside the capsule or mixed within one or more chambers inside the capsule. For instance, the capsule can include multiple chambers for containing individual ingredients and/or mixtures of ingredients that comprise a medicinal product.

Other combinations will occur to those of skill in the art. In some embodiments, additional filters, permeable or non-permeable membranes or walls can be provided within a given chamber of the container 12 and/or the capsule. to separate multiple beverage media. Similarly a filter can also be provided to separate beverage media from the fluid passageways through the capsule. In addition, another filter can be provided, e.g., to separate the beverage media from a fluid inlet or outlet.

As noted, the capsule 60 is preferably shaped to fit within the container 12 near the bottom 16. In the exemplary embodiment shown in FIGS. 5A-5C, for example, the outer side wall of the capsule 60 can be designed to have a diameter and extend vertically at an angle that matches the inner-diameter and angle of the inner wall of the container 12 near the bottom end 16 such that the capsule can snugly fit within the existing container 12 in a manner that maximizes the volume within the capsule and relies on a friction fit to maintain the capsule 60 in place. Moreover, because the container 12 has a frustoconical shape, it can be appreciated that the bottom-end diameter of the outer wall of the capsule 60 can have a size such that, when properly seated within the capsule, the capsule is positioned proximate to the bottom wall 16 of the container 12 yet having a separation that is a) suitable for permitting puncture of the bottom wall 16 and membrane 40 by an outlet needle and b) suitable for permitting the membrane 40 to deflect and allow fluid to flow through the capsule 60 and out of the cartridge 10 during beverage formation.

Figure 7A:
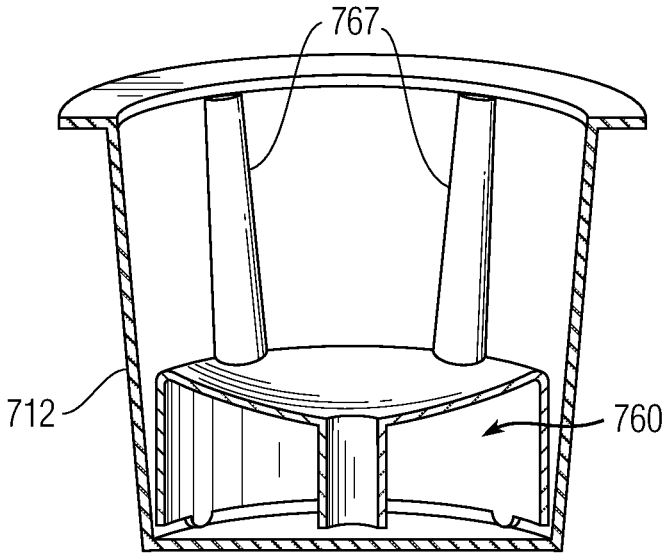
FIG. 7A is a cut-away side view of yet another illustrative embodiment of a cartridge in accordance with an aspect of the invention.
Figure 7B:
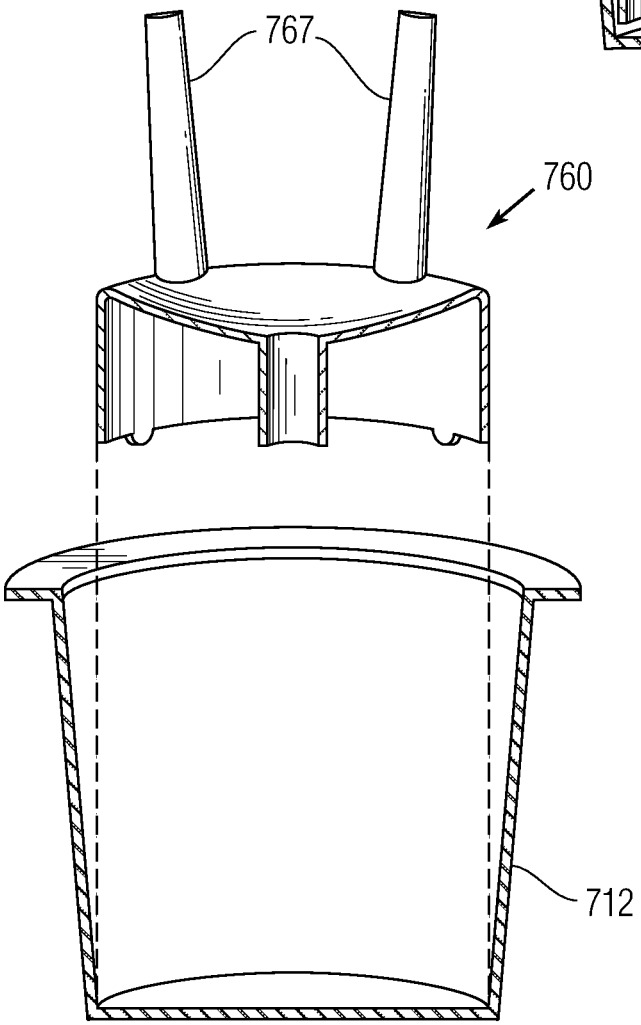
FIG. 7B is an exploded cut-away side view of the embodiment of FIG. 7A.
Figure 7C:
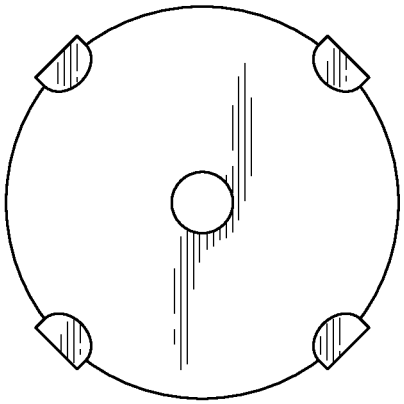
FIG. 7C is a top-view of the embodiment of FIG. 7A.

The basic capsule configuration can be further enhanced by inclusion of additional features for maintaining the capsule in a preferred position within the container. For example, FIGS. 7A and 7B are a cut-away diagram and exploded cut-away diagram, respectively, of an exemplary capsule 760 having legs 767. Although the cut-away views of FIGS. 7A and 7B omit the membrane and show only two legs, FIG. 7C is a top-view of the capsule 760 having four legs. It should be understood that more or fewer legs can be provided.

As shown in FIGS. 7A-7B, the legs 767 are positioned close to the periphery of the top side 762 of the capsule 760. The legs also extend from the top side 762 of the capsule in the vertical direction, which is the direction from the bottom of the container 712 toward the lid (not shown) and top end of the container 712. The legs are provided to brace against a lid and, as a result, maintain the capsule in position proximate to the bottom side of the container and prevent the capsule from moving substantially in the vertical direction prior to and during use. The legs are positioned near the outer margin of the capsule body and have a size and shape so as to not interfere significantly with the filter and its operation. The legs also have a length suitable to brace against the lid.

In addition or alternatively, legs or similar structural bracing members can be provided to brace against other components of the cartridge assembly. For example, bracing members can be provided to brace against one or more walls of the container 12. In addition or alternatively, bracing members can be provided to brace against the filter 30 and, in such a configuration, are preferably shaped to avoid puncturing or tearing the filter.

Figure 8A:
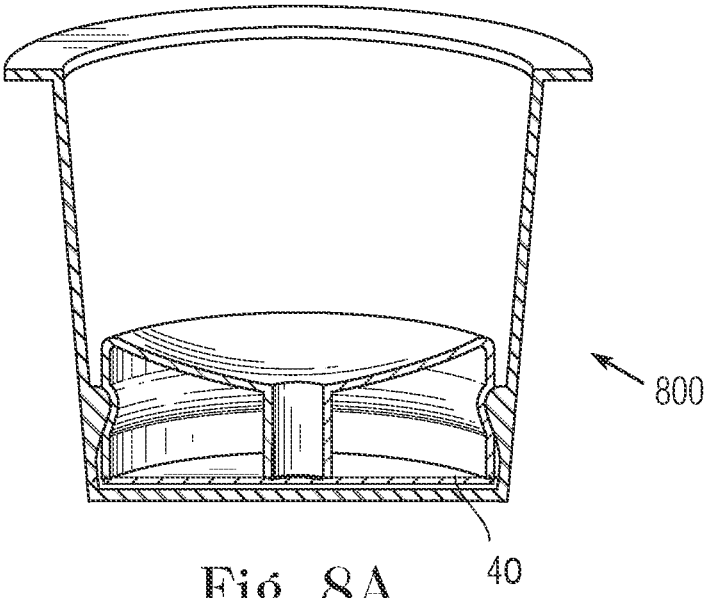
FIG. 8A is a cut-away side view of yet another illustrative embodiment of a cartridge in accordance with an aspect of the invention.
Figure 8B:
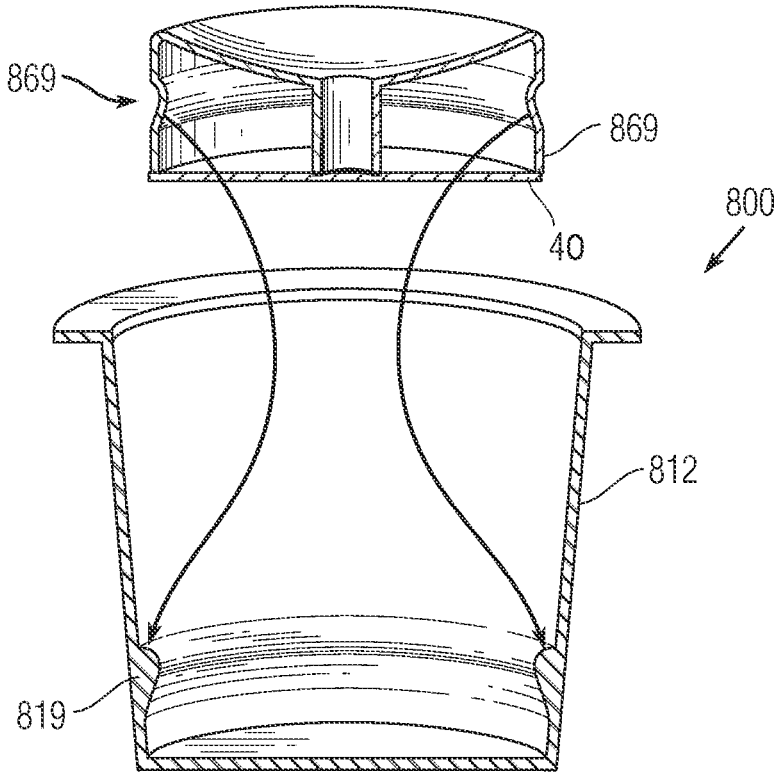
FIG. 8B is an exploded cut-away side view of the embodiment of FIG. 8A.

FIGS. 8A and 8B are a cut-away view and an exploded cut-away view of an exemplary configuration of a cartridge 800 and illustrate another exemplary configuration for maintaining the capsule in place within the container 812. As shown, at least the inner wall of the container can be provided with one or more peripheral lips or ribs 819 near the bottom end of the container. Alternatively, a conventional cartridge as described in the aforementioned patents can have a crimp imparted from the outer wall inwardly using heat contacted to the cartridge material to form the ribs 819. The outer wall of the capsule 860 can be formed to include a ring-like groove 869 that has a complementary shape to the lip 819. Accordingly, the complementary sized and shaped lip 819 and groove 869 can be configured to snap-fit together, thereby holding the capsule 860 in position and resisting movement.

Figure 10:
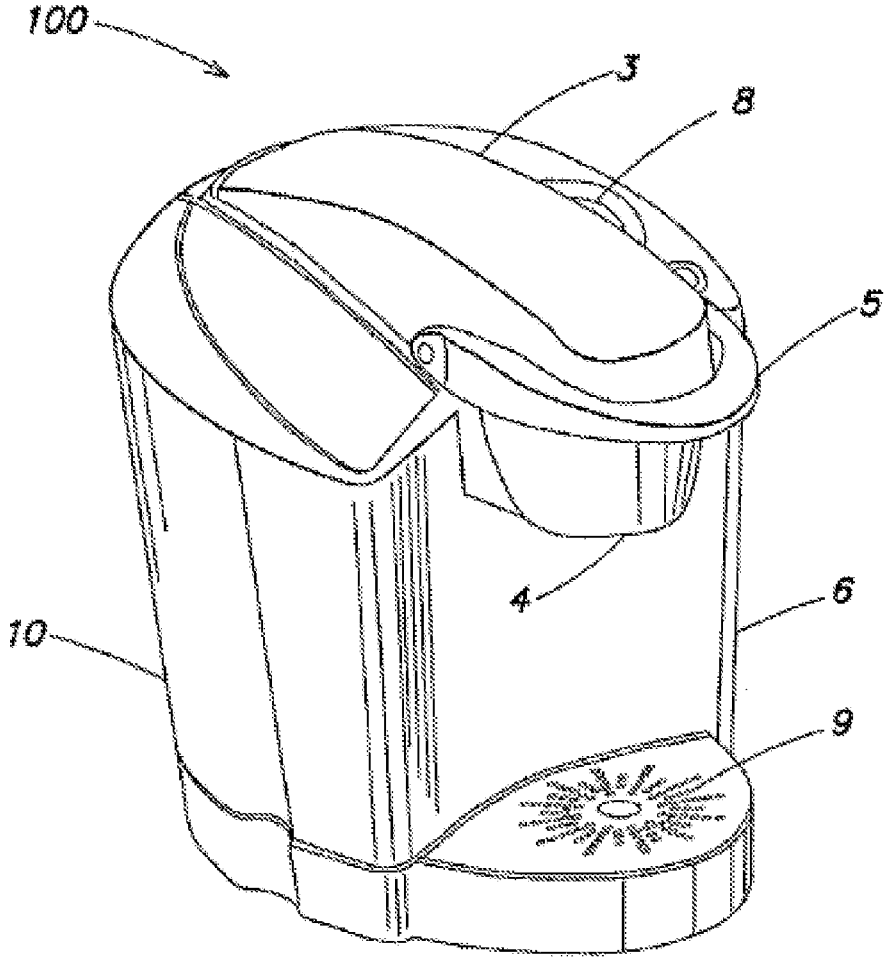
FIG. 10 is a perspective view of a beverage machine usable in accordance with aspects of the invention.

Cartridges in accordance with aspects of the invention can be used with any suitable beverage machine. For example, FIG. 10 shows a perspective view of a beverage forming apparatus 100 that can be used to form any suitable beverage, such as tea, coffee, other infusion-type beverages, beverages formed from a liquid or powdered concentrate, hot or cold drinks, etc. In this illustrative embodiment, the apparatus 100 includes an outer frame or housing 6 with a user interface 8 that the user can operate to control various features of the apparatus 100. A beverage cartridge can be provided to the apparatus 100 and used to form a beverage that is deposited into a cup or other suitable receptacle that is placed on a drip tray 9 or other support, if any. The cartridge can be manually or automatically placed in a cartridge receiving portion defined by first and second portions 3 and 4 of the beverage forming apparatus 100. For example, by lifting a handle 5, the user can move the first and second portions 3 and 4 to an open position to expose a suitably shaped area in which the cartridge can be placed. After placement of the cartridge, a handle 5 or other actuator can be moved in a manual or automatic fashion so as to move the first and second portions 3 and 4 to a closed position (shown in FIG. 10), thereby at least partially enclosing the cartridge within a brew chamber. It should be understood, however, that the cartridge can be received in any suitable way by the apparatus 100, as the way in which the apparatus 100 receives or otherwise uses the cartridge is not critical to aspects of the invention.

Once the cartridge is received, the beverage forming apparatus 100 can use the cartridge to form a beverage. For example, one or more inlet needles associated with the first or second portion 3, 4 can pierce the cartridge so as to inject heated water or other liquid into the cartridge. The first or second portion 3, 4 can also include one or more outlet needles or other elements to puncture or pierce the cartridge (as needed) at an outlet side to permit the formed beverage to exit the cartridge.

Figure 9:
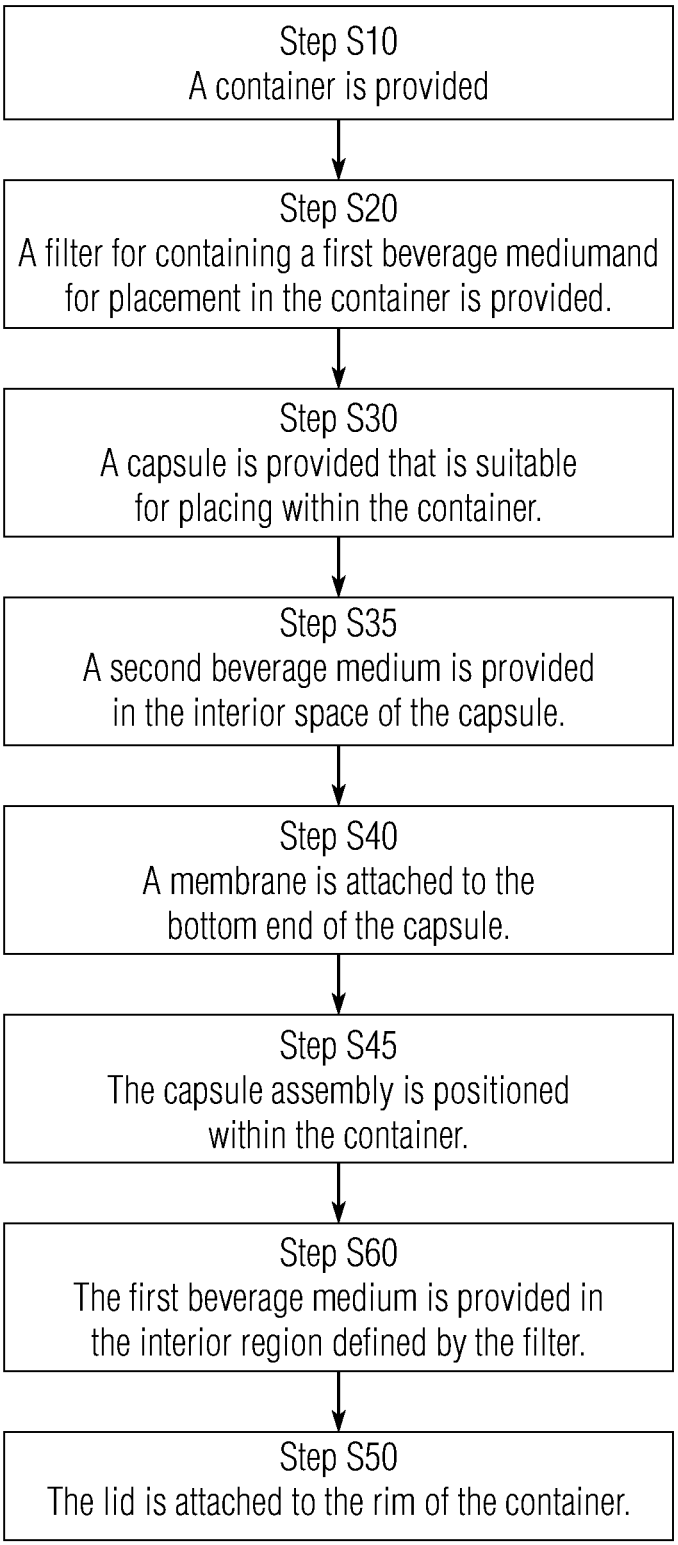
FIG. 9 shows steps in a method of manufacturing a cartridge in accordance with aspects of the invention.

Another aspect of the invention includes a method of manufacturing a capsule and an improved cartridge including the capsule, in accordance with one or more embodiments of the invention. Steps of one such illustrative method are shown in FIG. 9. (The steps in FIG. 9 are shown connected in dashed line so as to indicate that the steps of the method can be performed in different orders other than that shown, as described in more detail below.)

In step S10, a container having an interior space and a rim defining an opening into the interior space is provided. The container can be made of any suitable material, such as plastic, paper, metal and combinations of materials. Generally, the container is impermeable to liquid so that beverage created in the cartridge can be removed in a controlled way, but can have permeable portions. Also, the container can have any suitable shape, such as frustoconical, spherical, cylindrical, a rectangular box, and so on. Moreover, the container need not have a defined shape, and instead can be made of a flexible material.

In step S20, a filter is provided. In some configurations the filter can be configured to contain a first beverage medium and can be attached to a lid at a periphery. which is a closed boundary line where the filter is attached to the lid and extends away from the lid (e.g., into the interior space of the container). The filter can include any suitable material, such as filter paper, permeable or impermeable plastic material, a sponge like material, and so on. Also, the filter can include impermeable as well as permeable elements. For example, an impermeable plastic element can be attached to the lid and provide structural support for a filter paper or other material that is attached to the plastic element. The filter can have any suitable shape, size and/or permeability. For example, the filter can have areas of different permeability so as to prevent or restrict flow through some areas of the filter while facilitating flow through other, more permeable areas. Alternatively, or in addition, the filter can be attached to the container. As a further alternative, the filter can be freely placed in the first region such that it is not attached to the lid or container.

In step S30, a capsule is provided that is suitable for placing within the container and being positioned at the bottom of the chamber. Preferably, the capsule is sized and shaped to fit within the container and to avoid materially compromising the filter and to contain an amount of beverage medium suitable for the intended purpose. For example, the capsule can be an annular disk-shaped capsule having walls that are sized and shaped as described above.

In step S35, a beverage medium is provided in the interior space of the capsule, e.g., into the hollow chamber provided within the capsule. The chamber of the capsule can be filled with the beverage medium through the opening provided on the bottom of the capsule. The beverage medium can be a liquid or dry medium and can be arranged to interact with a liquid introduced in to the container to form a beverage.

In step S40, a membrane is attached to seal the capsule. In the exemplary configuration shown in FIG. 4A, for example, the membrane is attached to a bottom end of the cylindrical inner sidewall 62 and also attached at a bottom end of the cylindrical outer sidewall 64. In addition or alternatively, the membrane can be crimped circumferentially about the cylindrical outer sidewall. The membrane can include any suitable fluid non-permeable material including one or more of a metallic foil, polypropylene, cellulose material, a polymer laminate, e.g., formed from a sheet including a layer of polystyrene or polypropylene and a layer of EVOH and/or other barrier material. Also, the membrane can have a suitable elasticity. In addition, the attachment to the inner sidewall can have a suitable breaking point so as to permit a beverage introduced into the cartridge during beverage formation to break the seal and at least partially separate the membrane from the capsule wall and thereby allow fluid to flow into and out of the capsule.

The attachment can take place in one or more steps, for example the attachment to the cylindrical inner sidewall can occur first, followed by attachment of the membrane to the cylindrical outer sidewall. In addition, the attachment to the inner sidewall can be performed using a first joining means, for instance, a food-safe adhesive having a breaking threshold that is suitable for selectively breaking when a liquid is injected into the cartridge to form a beverage. In addition, the attachment to the outer sidewall can be achieved using another joining means, for instance, an adhesive that is configured to maintain a solid bond during beverage formation.

In step S45, the capsule assembly is placed within the interior volume of the container and placed into position.

In step S50, the lid is attached to the rim (e.g., to at least partially to close the opening). The lid can be attached to the rim in any suitable way, such as thermal or acoustic welding, adhesive, chemical bonding, mechanical bonding, and so on. In some embodiments, the rim can include a groove or other feature that assists in removal of the lid from the rim. The lid can be made of any suitable material, such as a foil, a foil and polymer laminate, a polymer material, and so on, and can be permeable or impermeable. However, the lid generally is made of a fluid impermeable material so as to aid in controlling the flow of liquid in the cartridge.

In step S60, a beverage medium is provided in the interior space of the cartridge, e.g., into a first region that is defined by the filter. The beverage medium can be contained by the filter and can be arranged to interact with liquid introduced into the container to form a beverage, and can include roast and ground coffee, leaf tea, instant coffee or tea, hot chocolate mix, a powdered drink mix, dried fruit materials, sweetener, creamer, thickener, and/or any other suitable material for forming a beverage.

It should be understood that steps in the method outlined in FIG. 9 can be performed in any suitable order. For example, in one embodiment, the first beverage medium can be provided in a space defined by the membrane and filter before the membrane and filter are attached to the lid or container. In another embodiment, the first beverage medium can be provided into a space defined by the membrane and filter after the membrane and filter are attached to the lid or container.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A cartridge and capsule for use in forming a beverage in a beverage machine that provides a pressurized liquid, comprising:

the cartridge, the cartridge including:

a container defining an interior space and having a bottom end, a lid closing an open top end of the container and that is pierceable by the beverage machine to accommodate an inflow of the pressurized liquid into the interior space to form the beverage, a filter disposed within the interior space and containing a first beverage medium arranged to interact with the liquid introduced into the container to form the beverage; and the capsule, the capsule including:

a body having an annular disc shape and an interior chamber that is hollow and is surrounding a central passageway and having a bottom end that is open, wherein the body is sized and shaped to be placed within the interior space of the container and positioned with the bottom end of the body proximate to a bottom end of the container, a membrane attached to the body and closing the open bottom end of the body and the central passageway, wherein the membrane is configured to selectively provide fluid communication between the interior space of the container and the interior chamber such that pressurized liquid introduced into the interior space of the container can flow into the interior chamber through the central passageway, and wherein the membrane is pierceable by a bottom outlet piercing element of the beverage machine to accommodate an outflow of the pressurized liquid, which is flowing into the interior chamber, through the membrane and out the bottom end of the container when pierced, a beverage medium is provided within the interior chamber and sealed therein by the membrane, wherein the beverage medium is arranged to interact with the liquid introduced into the container and flowing into the interior chamber to form the beverage, wherein the capsule is provided within the cartridge with the membrane of the capsule arranged proximate to the bottom end of the container to permit the bottom end of the container and the membrane to be pierced by the bottom outlet piercing element to permit the outflow of the beverage through the membrane and the bottom end of the container.

2. The cartridge and capsule of claim 1, wherein the annular disc shaped body comprises outer walls including an annular top wall that extends between a cylindrical inner wall and a cylindrical outer wall, wherein the cylindrical inner wall and cylindrical outer wall extend in a generally vertical direction, and wherein the cylindrical inner wall defines the central passageway, and wherein the membrane extends across a bottom end of the cylindrical inner wall and thereby closes the central passageway.

3. The cartridge and capsule of claim 2, wherein the membrane is attached to a bottom end of the cylindrical outer wall and the cylindrical inner wall, and wherein the attachment between the membrane and the cylindrical inner wall is configured to break in response to introduction of the pressurized liquid and thereby provides fluid communication between the interior space of the container and the interior chamber.

4. The cartridge and capsule of claim 3, wherein the membrane is attached to the bottom end of the cylindrical inner wall using a food-safe adhesive having a prescribed joining strength so that a stress above a prescribed threshold applied to the membrane through the central passageway causes the breakage of the attachment between the membrane and the cylindrical inner wall.

5. The cartridge and capsule of claim 4, wherein the membrane is configured to separate from the bottom end of the cylindrical inner wall allowing the liquid introduced into the interior space of the container to flow through the central passageway and into the interior chamber of the capsule.

6. The cartridge and capsule of claim 4, wherein the membrane is sealingly joined to at least a portion of the cylindrical outer wall using an adhesive arranged to maintain a seal when liquid is introduced into the interior space of the container.

7. The cartridge and capsule of claim 6, further comprising a plurality of radially extending chambers within the body.

8. The cartridge and capsule of claim 4, wherein the membrane extends beyond a perimeter of the cylindrical outer wall and is crimped circumferentially about the cylindrical outer wall.

9. The cartridge and capsule of claim 1, further comprising one or more legs extending in a vertical direction from a top wall of the capsule, wherein the one or more legs are configured to brace the capsule against the lid of the cartridge when the capsule is positioned within the interior space of the container and the lid is applied.

10. The cartridge and capsule of claim 9, wherein the capsule further comprises one or more dividing walls that extend radially from the cylindrical inner wall to the cylindrical outer wall and define the plurality of chambers.

11. The cartridge and capsule of claim 1, further comprising a plurality of chambers within the body.

12. The cartridge and capsule of claim 1, wherein an interior surface of the container of the cartridge includes a lip, and wherein an outer wall of the capsule body includes a depression configured to matingly engage the lip when the capsule is placed within the container.

13. An improved capsule and cartridge for forming a beverage in a beverage machine that provides a pressurized liquid, the cartridge having a container defining an interior space, a lid closing an open top end of the container and that is pierceable by the beverage machine to accommodate an inflow of the pressurized liquid into the interior space to form the beverage, and a filter disposed within the interior space and containing a first beverage medium arranged to interact with the pressurized liquid introduced into the container to form the beverage and a bottom end of the container that is pierceable by a bottom outlet piercing element of the beverage machine to accommodate an outflow of the beverage from the interior space, the improvement comprising:

a capsule provided within the cartridge with a membrane of the capsule arranged proximate to the bottom end of the container to permit the bottom end of the container and the membrane to be pierced by the bottom outlet piercing element to permit an outflow of the beverage through the piercing, the capsule further comprising:

a body having an annular disc shape and an interior chamber that is hollow and is surrounding a central passageway and having a bottom end that is open, wherein the body is sized and shaped to be placed within the interior space of the container and positioned with the bottom end of the body proximate to a bottom end of the container;

the membrane attached to the body and closing the bottom end of the body and the central passageway, wherein the membrane is configured to selectively provide fluid communication between the interior space of the container and the interior chamber such that pressurized liquid introduced into the interior space of the container can flow into the interior chamber through the central passageway, and wherein the membrane is pierceable by the bottom outlet piercing element of the beverage machine to accommodate an outflow of the pressurized liquid, which is flowing into the interior chamber, through the membrane and out the bottom end of the container when pierced;

a beverage medium provided within the interior chamber and sealed therein by the membrane, wherein the beverage medium is arranged to interact with the pressurized liquid introduced into the container and flowing into the interior chamber to form the beverage.

14. The capsule of claim 13, wherein an outer wall of the capsule has a diameter such that the capsule seats within the container of the cartridge with the bottom end of the capsule and the membrane positioned proximate to the bottom end of the container to permit piercing yet having a separation that enables separation of the membrane from a bottom end of the capsule.

15. The capsule of claim 13, wherein the annular disc shaped body comprises outer walls including an annular top wall that extends between a cylindrical inner wall and a cylindrical outer wall, wherein the cylindrical inner wall and cylindrical outer wall extend in a generally vertical direction, and wherein the cylindrical inner wall defines the central passageway, wherein the membrane extends across a bottom end of the cylindrical inner wall and thereby closes the central passageway, wherein the membrane is attached to a bottom end of the cylindrical outer wall and the cylindrical inner wall, and wherein the attachment between the membrane and the cylindrical inner wall is configured to break in response to introduction of the pressurized liquid and thereby provides fluid communication between the interior space of the container and the interior chamber.

16. The capsule of claim 15, wherein the membrane is attached to the bottom end of the cylindrical inner wall using a food-safe adhesive having a prescribed joining strength so that a stress above a prescribed threshold applied to the membrane through the central passageway causes the breakage of the attachment between the membrane and the cylindrical inner wall, and wherein the membrane is sealingly joined to at least a portion of the cylindrical outer wall so as to maintain a seal when liquid is introduced into the interior space of the container.

17. The capsule of claim 13, further comprising one or more legs extending in a vertical direction from a top wall of the capsule, wherein the one or more legs are configured to brace the capsule against the lid of the cartridge when the capsule is positioned within the interior space of the container and the lid is applied.

18. The capsule of claim 13, wherein an interior surface of the container of the cartridge includes a lip, and wherein an outer wall of the capsule body includes a depression configured to matingly engage the lip when the capsule is placed within the container.

19. A method of manufacturing an improved ingredient capsule and cartridge for forming a beverage in a beverage machine that provides a pressurized liquid into the cartridge, the method comprising:

providing a container of the cartridge, the container defining an interior space and having an open top end and a bottom end that is pierceable by a bottom outlet piercing element of the beverage machine, providing a capsule within the cartridge, the capsule comprising:

a body having an annular disc shape and a hollow interior chamber surrounding a central passageway and having an open bottom end, wherein the body is sized and shaped to be placed within the interior space of the container and positioned with the bottom end of the body proximate to the bottom end of the container, a membrane attached to the body and closing the open bottom end of the body and the central passageway, wherein the membrane is configured to selectively provide fluid communication between the interior space of the container and the chamber such that the pressurized liquid introduced into the interior space of the container can flow into the chamber through the central passageway, and a beverage medium within the interior chamber and sealed therein by the membrane, wherein the beverage medium is arranged to interact with the liquid introduced into the container and flowing into the chamber, and wherein the capsule is disposed within the container such that the membrane is arranged proximate to the bottom end of the container to permit the bottom end of the container and the membrane to be pierced by the bottom outlet piercing element to permit an outflow of the beverage through the piercing of the membrane and the container;

providing the filter of the cartridge within the interior space of the container, the filter containing a first beverage medium arranged to interact with the liquid introduced into the container to form the beverage; and closing the open top end of the container with a lid that is pierceable by the beverage machine to accommodate an inflow of the pressurized liquid into the interior space to form the beverage.

* * * * *